US005564237A

United States Patent [19]

Yoneda

[11] Patent Number: 5,564,237

[45] Date of Patent: Oct. 15, 1996

[54] EARTHQUAKE RESISTING SUPPORT CONSTRUCTION FOR STRUCTURES

[76] Inventor: Ryozo Yoneda, 3-27-9 Koenjikita, Suginame-Ku, Tokyo-To Tokyo, Japan

[21] Appl. No.: 285,133

[22] Filed: Aug. 3, 1994

[30] Foreign Application Priority Data

Aug. 4, 1993 [JP] Japan ..... 5-211102

[51] Int. Cl.[6] ..... E02D 27/34; E04B 1/98

[52] U.S. Cl. ..... 52/167.5; 52/167.4; 52/292

[58] Field of Search ..... 52/167.1, 167.4, 52/167.5, 167.6, 292

[56] References Cited

U.S. PATENT DOCUMENTS

| | | | |
|---|---|---|---|
| 845,046 | 2/1907 | Bechtold | 52/167.5 |
| 1,761,660 | 6/1930 | Cummings | 52/167.5 |
| 2,014,643 | 9/1935 | Bakker | 52/167.1 X |
| 2,208,872 | 7/1940 | Ropp | 52/167.5 |
| 3,748,800 | 7/1973 | Glicksberg | 52/167.4 |
| 3,952,529 | 4/1976 | Lefever | 52/167.1 X |
| 4,063,394 | 12/1977 | Feuerlein | 52/167.1 X |
| 4,124,963 | 11/1978 | Higuchi | 52/292 X |
| 5,067,289 | 11/1991 | Ouderkirk et al. | 52/292 X |
| 5,081,806 | 1/1992 | Pommelet | 52/167.5 |

FOREIGN PATENT DOCUMENTS

| | | | |
|---|---|---|---|
| 57-169134 | 10/1982 | Japan | 52/292 |
| 1-278641 | 11/1989 | Japan | 52/167.4 |
| 4-149320 | 5/1992 | Japan | 52/167.4 |
| 675137 | 7/1979 | U.S.S.R. | 52/167.4 |
| 1283296 | 1/1987 | U.S.S.R. | 52/167.5 |
| 1701875 | 12/1991 | U.S.S.R. | 52/167.4 |

*Primary Examiner*—Wynne E. Wood
*Assistant Examiner*—Laura A. Saladino
*Attorney, Agent, or Firm*—Emmanuel J. Lobato

[57] ABSTRACT

An earthquake resisting support construction which supports a structure at a required position on the surface of ground having a bearing capacity of soil large enough to withstand the weight of the structure, comprising, at each support position: a number of base-stones buried and arranged in the ground to provide a horizontal finished top surface; a cornerstone having parallel top and bottom surfaces and disposed on the number of base-stones to produce friction between the finished top surface of the base-stones and the bottom of the cornerstone; and a pedestal having a centrally-disposed void in its bottom and mounted on the cornerstone, with the marginal portion of its bottom held in frictional contact with the top of the cornerstone.

4 Claims, 5 Drawing Sheets

EARTHQUAKE RESISTING SUPPORT CONSTRUCTION FOR STRUCTURES

BACKGROUND OF THE INVENTION

The present invention relates to an earthquake resisting support construction which shields structures from horizontal forces of earthquakes.

A fact that a structure withstands an earthquake means that the structure has an energy retaining capacity larger than the energy of an earthquake as an external force applied thereto. Hence, structures are usually designed to have a horizontal bearing capacity calculated on the basis of an assumed large seismic force to ensure safety from destruction by earthquakes below the assumed seismic force.

Accordingly, there is a strong possibility of such structures being destroyed by earthquakes larger than assumed. Even if the structures do not collapse when an earthquake occurs within the assumed range of seismic force, it is unknown whether people and objects at upper stories of skyscrapers or ultra-high-rise buildings, for instance, would endure severe shaking of the building designed to cancel the horizontal seismic force.

On the other hand, an aseismatic structure is also designed on the assumption that the structure itself is exposed to the horizontal force of an earthquake, while it is equipped with an antiseismic device represented by a slip and elasticity system, as defined as a "structure designed, in particular, to minimize the influence of earthquake motion, taking its properties into account."

Besides, a novel type of construction called a damping structure is now being developed with a view to artificially controlling the motion of a building that is caused by an earthquake; however, this is also predicated on an idea that the structure itself is exposed to the horizontal force of earthquake.

As mentioned above, present-day structures or buildings are constructed on the predication that they are subject to the horizontal seismic force, and they are required to have a horizontal bearing capacity corresponding to the horizontal seismic force. Thus, no aseismatic support construction has been proposed which prevents the horizontal seismic force from transmission to structures or buildings.

SUMMARY OF THE INVENTION

An object of the present invention is to provide an earthquake resisting support construction which completely inhibits the application of the horizontal force of an earthquake to structures, and hence prevents their destruction by earthquake motion and allows people and objects in the structures to stay free from the influence of the horizontal force of the earthquake.

To attain the above object, the earthquake resisting support construction which supports a structure at a required position on the surface of ground having a bearing capacity of soil large enough to withstand the weight of the structure, comprising, at each support position;

a number of base-stones buried and arranged in the ground to provide a horizontal finished top surface;

a cornerstone having parallel top and bottom surfaces and disposed on the horizontal finished top surface provided by the number of base-stones to produce friction between the finished top surface by the base-stones and the bottom surface in the form of a recess on its bottom surface of the cornerstone; and a pedestal having a centrally-disposed void in its bottom and positioned on the top surface of the cornerstone, with a resultant marginal portion of its bottom surface held in frictional contact with the top surface of the cornerstone;

wherein when an earthquake occurs in the ground, the cornerstone is caused by a horizontal oscillatory wave of the earthquake to horizontally slide on the finished top surface provided by the base-tones, providing an earthquake resisting capability for the structure.

In case of accuring an earthquake in the ground, in another aspect of the present invention, the base-stones are caused by a horizontal oscillatory wave of the earthquake rotate and horizontally slide on the ground plane, providing an earthquake resisting capability for the structure.

BRIEF DESCRIPTION OF THE DRAWINGS

The present invention will be described in detail below with reference to accompanying drawings, in which.

DETAILED DESCRIPTION

Referring now to the accompanying drawings, the present invention will be described concretely.

Figure 1:
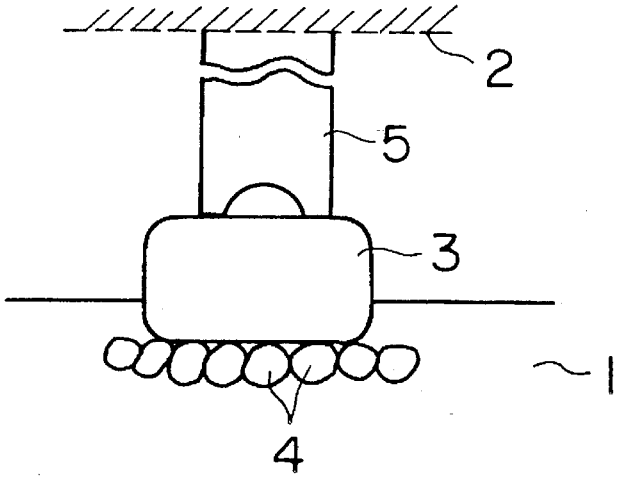
FIG. 1 is a schematic sectional view illustrating an aspect of the support construction according to the present invention.

FIG. 1 is a sectional view schematically illustrating an aspect of the support construction ,according to the present invention. Assume that the ground 1 is a good one which has a bearing capacity of soil supporting a structure 2, such as improved or man-made ground. Base-stones 4 are laid at the position of a cornerstones 3 and are sufficiently pounded into the ground 1. This provides in the ground surface a horizontal finished top surface by the base-stones 4 integrated with the ground 1.

The corner stone 3 having a horizontal top is placed on the base-stones 4 and then a pedestal 5 of the structure 2 is mounted on the top end face of the cornerstone 3. The dead weight of the cornerstone 3 and the dead weight of the structure 5 thereon are combined to generate a large frictional force in the contact plane between the base-stones 4 and the cornerstone 3. Similarly, large friction is produced between the bottom of the pedestal 5 and the top of the cornerstone 3 as well. Of course, the cornerstone 3 is not joined to the base-stones 4 and nor the pedestal 5 is joined to the cornerstone 3. In other words, the pedestal 5 is positioned on the top surface of the cornerstone 3 without a mutual joint member.

The bottom of the pedestal 5 is made to remain horizontal, the rim of its bottom is shaped to be inscribed in a circle or regular polygon and the bottom has a centrally-disposed void such that a resultant marginal or outer portion of the bottom surface contacts the top of the cornerstone 3.

When the horizontal seismic force acting in the friction planes on and under the cornerstone 3 happens to exceed the maximum frictional force that the friction planes are allowed to transmit, the base-stones 3 move by the acceleration of earthquake, whereas the cornerstone 3 and the pedestal 5 both tend to stay by inertia since they are free with respect to the base-stones 4. That is, the cornerstone 3 and the pedestal 5 are subjected to inertial force opposite in the direction to the acceleration of earthquake, resulting in the base-stones 4 and the cornerstone 3 sliding relative to each other in the friction plane therebetween.

Figure 2:
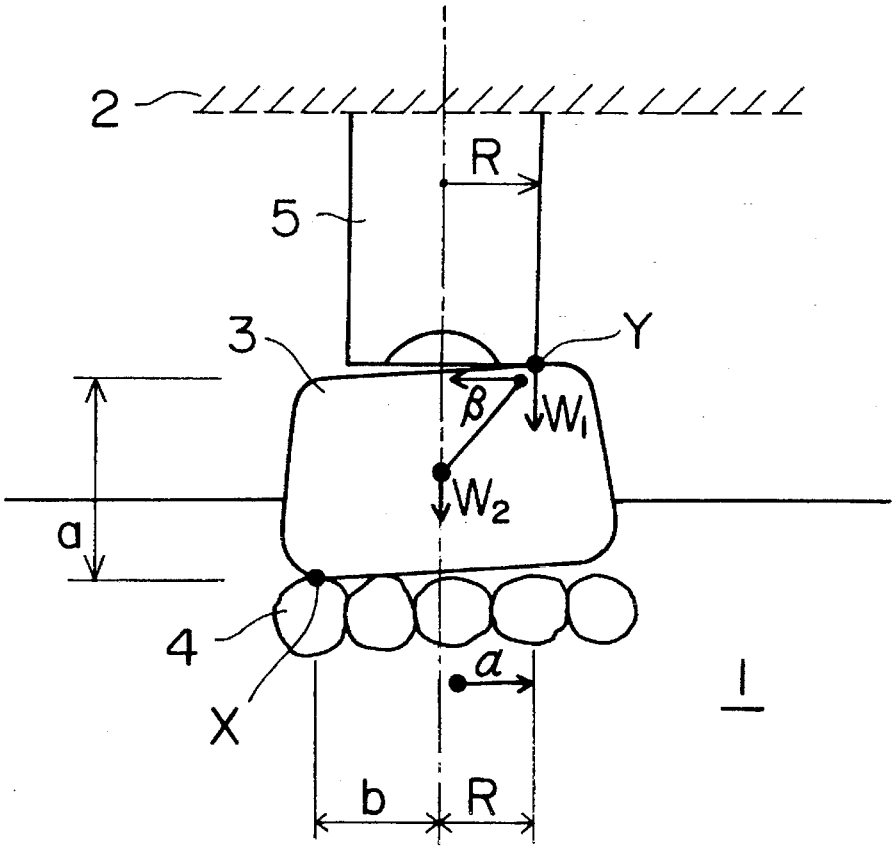
FIG. 2 is a schematic diagram showing relationships of forces when the horizontal seismic force is exerted on the support construction of the present invention illustrated in FIG. 1.

The frictional force acts on the contact plane between the cornerstone 3 and the base-stones 4 until immediately before their relative sliding movement. FIG. 2 is a diagrammatic showing of forces acting immediately before they start to slide relative to each other. If the marginal portion of the bottom of the pedestal 5 is ring shaped, the forces that are exerted by a given seismic force at the point x (a line in practice) to which the frictional force is transmitted are only $W_1$, $W_2$ and $\beta$ as shown in FIG. 2. That is, the cornerstone 3 tends to turn in the counterclockwise direction by dint of inertial force $\beta$. Letting the dead weight of the structure 2 and the dead weight of the cornerstone 3 be represented by $W_1$ and $W_2$, respectively, the turning force F of the latter is expressed by $a\beta\ (W_1+W_2)$. On the other hand, the dead weight $W_2$ of the cornerstone 3 and the weight $W_1$ of the structure 2 applied to the pedestal 5 produce a clockwise force which arrests the turning motion of the cornerstone; the force is given as follows:

$$bW_2 + (b + R)W_1 = b(W_1 + W_2)RW_1 \quad (1)$$

If $$b(W_1 + W_2) + RW_1 - a\beta(W_1 + W_2) > 0$$

the cornerstone will not turn.

Now, assume concrete numerical values in FIG. 2. The inertial force $\beta$ is equal in magnitude to the seismic force $\alpha$ but opposite in direction thereto. Let it be assumed that the value of the inertial force $\beta$ is 0.2 G. The weight $W_1$ of the structure 2 that is applied to the pedestal 5 is usually in the range of several to tens of tons; now, assume that the weight is 5 tons=5000 kg. Further, numerical values of the structures and other values will be supposed as follows:

a=0.54 m; b=0.45 m; R=0.235 m; $W_1$=5000 kg; $W_2$=400 kg; $\beta$=0.2 G

Substituting these values into Eq. (1), we have $$b(W_1+W_2)+RW_1-a\beta(W_1+W_2)=0.45\times(5000+400)+0.235\times5000-0.54\times0.2\times(5000+400)=3021.8>0$$

That is, the cornerstone 3 tends to turn by dint of the seismic force but the force that arrest the turning motion is so large that the turning force is cancelled.

The above dynamic principles of operation of the present invention will be further described with the aid of a model.

Incidentally, b in Eq. (1) represents the distance from the center axis of the pedestal 5 to the center of rotation X of the cornerstone 3 and is determined by the shape of the bottom of the cornerstone 3. b=0 A condition: means that the center of rotation of the cornerstone is on the center axis of the pedestal 5.

This is in the case where the lower portion of the cornerstone 3 is hemispherical. In this case the following result $$b(W_1+W_2)=0$$

is obtained and the following equation is derived form Eq. (1).

$$RW_1-a\beta(W_1+W_2)>0 \quad (2)$$

If $RW_1$ is larger than $a\beta(W_1+W_2)$, then the cornerstones will not turn, When b=0, $RW_1$=0.235×5000=1175 (kg·m)

$a\beta(W_1+W_2)$=0.54×0.2×(400+5000)=583.2 (kg·m)

Thus, Eq. (2) holds.

As described above, the inertial force $\beta$, which is proportional to the seismic force, acts as a force that turns the cornerstone 3 within the range of the maximum frictional force in the contact plane between the base-stones 4 and the cornerstone 3. In contrast thereto, the weight of the structure 2 mainly produces a force that arrests the turning motion of the corner-stone 3, although the dead weight of the cornerstone 3 may some-times be added according to the shape of its bottom.

The ring-shaped bottom of the pedestal 5 is a means whereby when the cornerstone 3 turns, the weight $W_1$ of the structure 2 is instantaneously shifted to the point Y where the bottom of the pedestal undergoes a maximum displacement on the top of the cornerstone 3; that is, the ring-shaped bottom efficiently utilizes the weight $W_1$ of the structure 2 to prevent the cornerstone 3 form turning.

Figure 3:
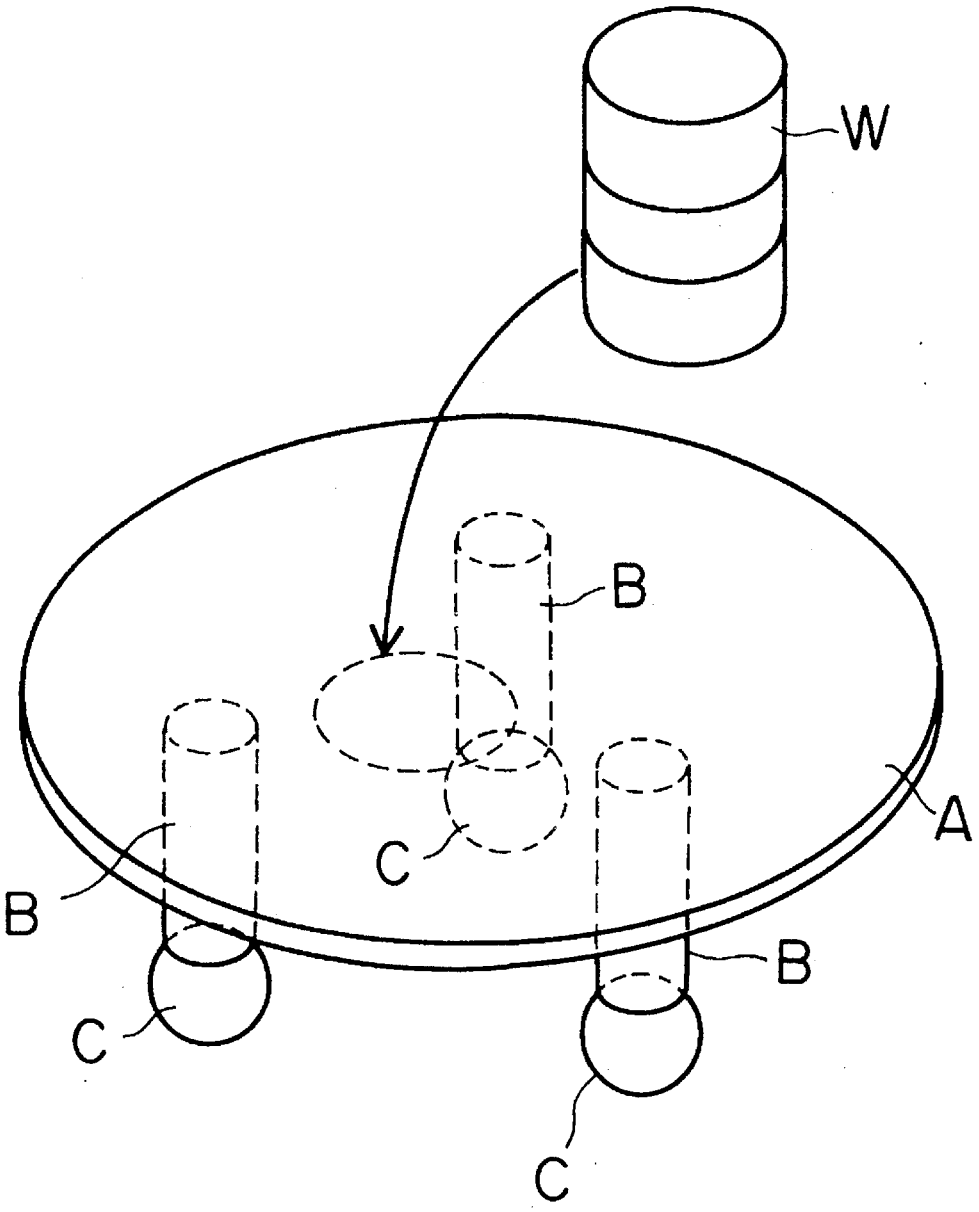
FIG. 3 is a schematic diagram explanatory of the operation or motion of the support construction of the present invention when the horizontal seismic force is exerted thereon.
Figure 4:
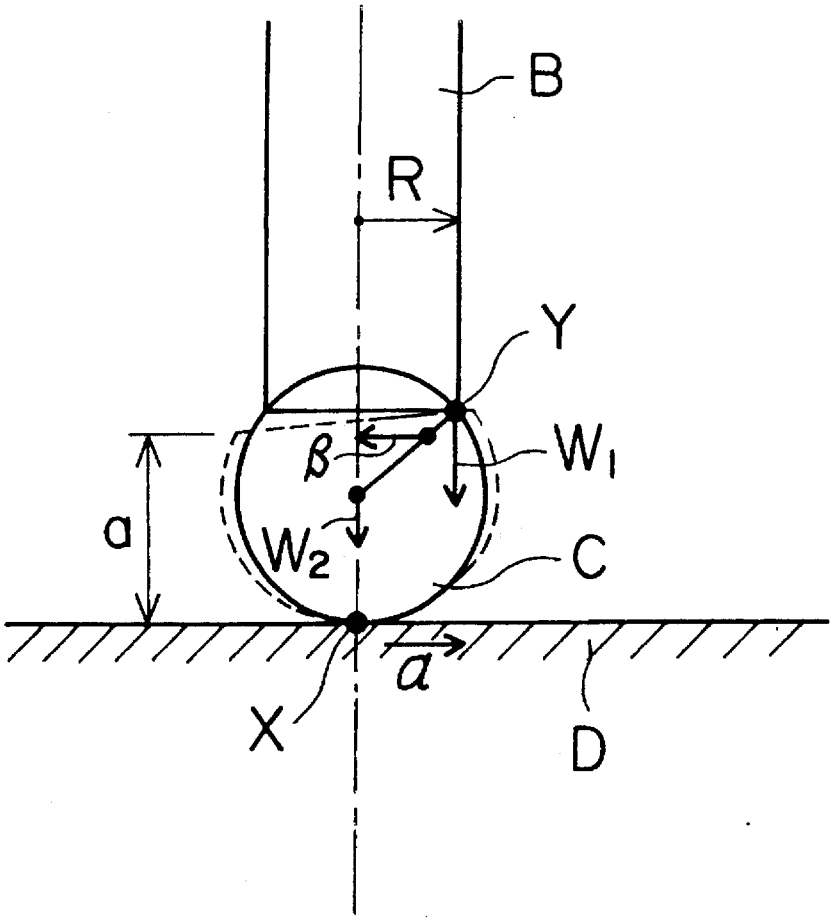
FIG. 4 is a schematic diagram explanatory of the operation or motion of the support construction of the present invention when the horizontal seismic force is exerted thereon.

To demonstrate the principles of the present invention, there is shown in FIG. 3 a model of an example of a structure mounted on balls. Reference character A denotes an acrylic disc, B acrylic pipes bonded to the acrylic disc A perpendicularly thereto, C acrylic balls rotatably attached to the lower ends of the acrylic pipes B and W a weight on the disc A. FIG. 4 shows in section one of the pedestal. The contact portion between the a circle of the inner diameter R of the acrylic pipe B and the ball C is linear but indicates the bottom of the pedestal in FIG. 2. In FIG. 4, $W_1$ represents the weight that is applied to the acrylic pipe B, $W_2$ the weight of the ball C and a the height of the center of gravity of $(W_1+W_2)$ when the weight $W_1$ acts on the point Y.

At this time, the inertial force $\beta$ proportional to the seismic force $\alpha$ is exerted on the ball C on the frictional plane of ground D, turning it counterclockwise. It can be seen, however, that since the weight $W_1$ of the structure is exerted on the point Y, the ball turns clockwise at the next moment. This indicates the behavior of the forces that are exerted on the broken-lined cornerstone 3 subjected to the inertial force $\beta$.

With respect to the point X, the counterclockwise force $a\beta(W_1+W_2)$ is cancelled by the clockwise force $RW_1$.

The illustrated model reveals that it is the basics of this construction to hold the pedestal to be horizontal and to make its bottom ring-shaped.

Figure 5:
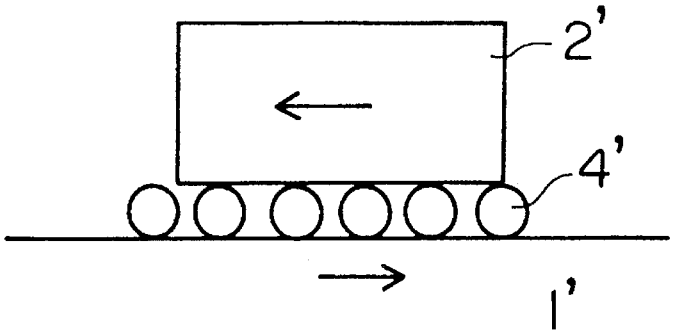
FIG. 5 is a schematic diagram explanatory of the operation or motion of the support construction of the present invention when the horizontal seismic force is exerted thereon.

It is also evident from the model that the construction of the present invention is a sort of such an aseismatic structure as shown in FIG. 5 which is mounted on ball bearings.

In the case of FIG. 5, the structure 2' and the ground 1' are displaced by an earthquake symmetrically with respect to the center of the ball bearing assembly 4'.

Figure 6:
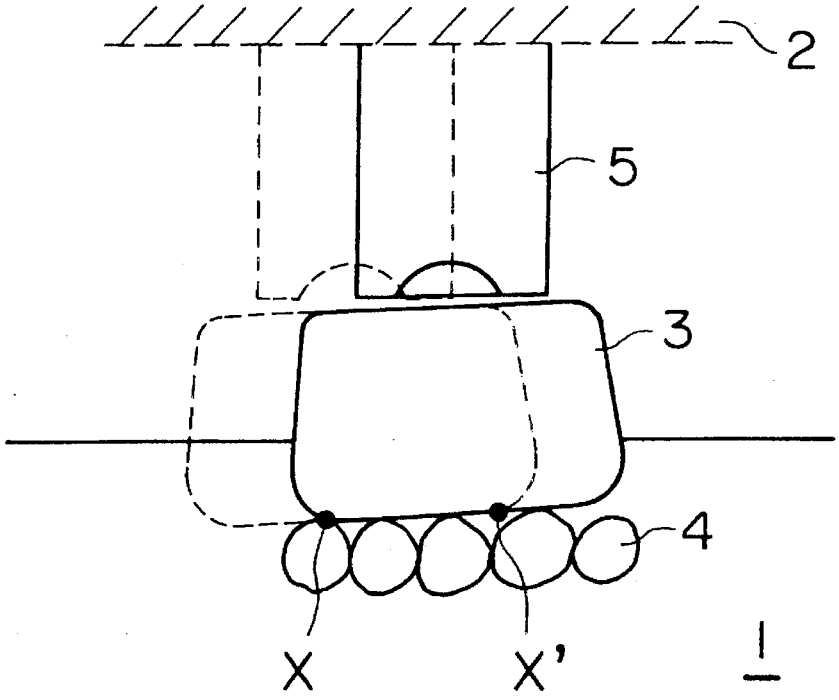
FIG. 6 is a sectional view explanatory of the operation or motion of the support construction of the present invention when the horizontal seismic force is exerted thereon.

With the construction of the present invention, however, at an instant when the cornerstone 3 is lifted on the verge of turning, the cornerstone 3 and the base-stones 4 make contact with each other at the point X and slide relative to each other by owing to an inertial force exceeding the maximum frictional force produced between them. "The cornerstone and the structure" slide as one body by the displacement of the ground while being resisted at the point X. When they reach the position indicated by the broken lines in FIG. 6, the cornerstone 3 is lifted with the fulcrum at the point X' in the direction opposite to that in the above.

In the case of FIG. 5, the structure 2' is displaced by inertia with respect to its center when it stands still, in the direction opposite to that of displacement of the ground 1'. With the construction of the present invention, the structure 2 stays at its standstill position. That is, the structure 2 is free from the horizontal seismic force. It is understood that the upper area formed by the base-stones 4 is required to be wide enough to accommodate the displacement of the ground by an earthquake.

As described above in detail, according to an aspect of the present invention, (1) the turning motion of the cornerstone follows the principle of equilibrium of forces shown in FIG. 2 and (2) that the cornerstone is free and that balls can be regarded as constituting its point of application of force reveal that the structure of the construction according to the present invention is based on the same principle as that of the structure mounted on the ball bearings.

(3) Since the contact between the pedestal and the cornerstone changes from a plane to a point while at the same time the contact between the cornerstone and the base-stones changes from a plane to a line or point, the plane of friction normally ensures the stability of the structure and permits the sliding motion of the (cornerstone+structure) when an earthquake occurs.

A combination of the above-mentioned three point constitutes a method of shielding structures from the horizontal seismic force.

According to the present invention, materials for the base-stones, cornerstone and pedestal may be various combinations such as stone-stone-wood, stone-stone-stone, stone-concrete-iron, stone-iron-iron, etc. The present invention is of very wide industrial application when taking into account the construction method, weather resistance and so forth.

The above example of the construction according to an aspect of the present invention is described, which is mainly supported by a relationship (i.e. upper construction) between the pedestal 5 and the cornerstone 3. However, a relationship (i.e. lower construction) between the ground and the cornerstone 3 via the base-stones 4 plays an important part in an earthquake resisting support construction for inhibiting the application of the horizontal forces of earthquake to structures.

Therefore, another aspect of the present invention will be described from a point of view where the lower construction is employed as a more important member.

[Lower Construction]

This is the relationship among the ground 1, the base-stones 4 and the cornerstone 3.

The base-stones 4 are similar to broken stones or rubbles and are required to have the same strength as the latter. They are disposed just line chestnuts. The ground 1 is ground which withstands the upper weight and the weight that is exerted perpendicularly when an earthquake occurs.

Figure 7:
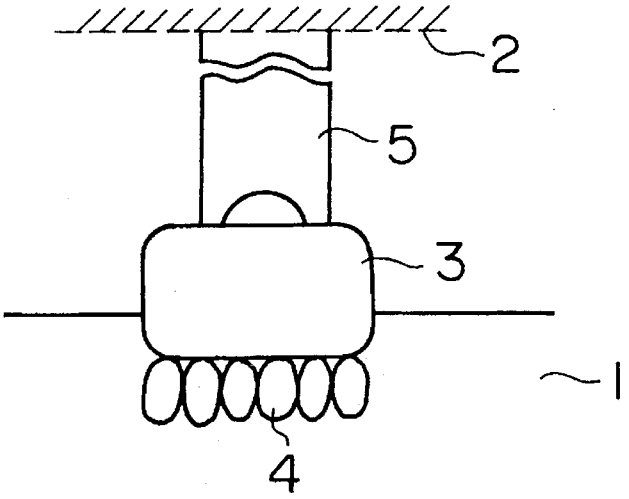
FIG. 7 is a schematic sectional view illustrating another aspect of the support construction according to the present invention.

This method has long been employed but its earthquake resisting property has not been noted. A description will be given, with reference to FIG. 7, of how the base-stones 4 and the cornerstone 3 move by dint of an seismic force α. When the ground 1 moves to the right by the seismic force α, the lower ends of the base-stones 4 are in contact with the ground 1 and hence move to the right together with the ground 1. When an earthquake occurs, the top end portion of each base-stone 4, which the center of weight, tends to stay there by the law of inertia, with the result that the base-stones turn to the left. Of course, the base-stones 4 are not turned by the seismic force α of long period. The seismic force α of the range in which the rubble-like base-stones 4 are turned is dissolved by the above-said leftward turning motion and is not exerted on the cornerstone 3 and the pedestal 5. When the seismic force a further increases, the base-stones 4 are completely turned to the left. At this time, the base-stones 4, the cornerstone 3 and the pedestal 5 become one body or unitary structure against the seismic force α. The whole structure is exposed to the inertial force of the seismic force α and tends to stay at the position where they lie at that time. Accordingly, the ground 1 moves to right by the seismic force α and slides under the base-stones 4. Thus, the base-stones 4, the cornerstone 3 and the pedestal 5 are free from the seismic force α.

As mentioned above, the relationship between the ground 1, the base-stones 4 and the cornerstone 3 provides an earthquake-free property. This is in agreement with the statement of a person who experienced the Great Kanto Earthquake (of 1923) that he could walk only on paving stones for streetcars during after-shocks. This is the principle on which stone lanterns or the like do not collapse with earthquakes. That is, the earthquake-free construction method of a heavy structure of a low center of gravity is thus obtained.

[Upper Construction]

As will be seen from the above, the base-stones 4 in the prior art construction method turn about their lower ends owing to the seismic force (except the seismic force of long period). The cornerstone 3 on the base-stones 4 are free from the seismic force a but its top end face cannot be held horizontal because of the turning motion of the base-stones 4. When the top end face of the cornerstone 3 remains horizontal and the corner-stone is not exposed to the seismic force α, buildings will not be broken, but some buildings constructed in the past were broken. That is, it is necessary to introduce a new idea into the relationship between the top end face of the cornerstone 3 and the bottom of the pedestal 5.

Now, a description will be given of the relationship between the cornerstone 3 and the pedestal 5 which forms the upper construction of this construction method. Let it be assumed that the cornerstone 3 is on the base-stones 4 which are moved by the seismic force α and that the base-stones 4 are integrated with the ground 1 and will not turn. In such an instance, the cornerstone 3 is exposed to a force β which turns it to left by the seismic force α as shown in FIG. 8.

In case of the latter aspect of the present invention, "the cornerstone and the structure" remain at their original positions based on the lower construction irrespectively of the displacement of the ground.

Figure 8:
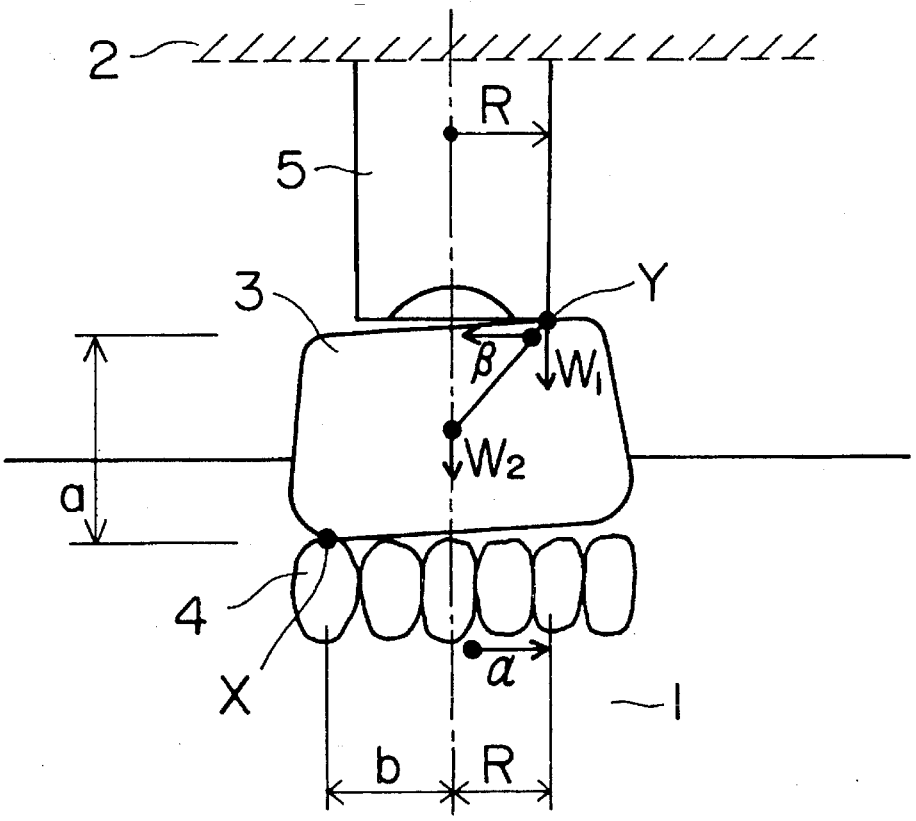
FIG. 8 is a schematic diagram showing relationships of forces when the horizontal seismic force is exerted on the support construction of the present invention illustrated in FIG. 7.

As described in detail, according to another aspect of the present invention, (1) the turning motion of the cornerstone of the upper construction follows the principle of equilibrium of force shown in FIG. 8, and (2) that the cornerstone is free and that balls can be regarded as constituting its point of application of force reveal that the structure of the construction according to the present invention is based on the same principle as that of the structure mounted on the ball bearings. (3) The lower construction normally ensures the stability of the structure and permits the sliding motion of "the cornerstone and the structure", when an earthquake occurs, by the effect motion of the base-stones.

What I claim is:

1. An earthquake resisting support construction which supports a structure at required support positions on the surface of ground having a bearing capacity of soil large enough to withstand the weight of the structure, comprising, at each of said support positions:

a number of base-stones buried and arranged in the ground to provide a horizontal finished top surface;

a cornerstone having parallel top and bottom surfaces and disposed on the horizontal finished top surface provided by said number of base-stones to produce friction between the finished top surface provided by the base-stones and the bottom surface of the cornerstone; and a pedestal having a centrally disposed recess on its bottom surface and positioned on the top surface of the cornerstone free of any mutual joining member therebetween except weight, with a resultant marginal portion of its bottom surface held in frictional contact with the top surface of the cornerstone;

wherein when an earthquake occurs in the ground, the cornerstone is caused by a horizontal oscillatory wave of the earthquake to horizontally slide on the finished top surface provided by the base-stones, providing an earthquake resisting capability for the structure.

2. An earthquake resisting support construction which supports a structure at required support positions on the surface of ground having a bearing capacity of soil large enough to withstand the weight of the structure, comprising, at each of said support positions:

a number of base-stones buried and arranged in the ground to provide a horizontal finished top-surface, each of said base-stones having a chestnut-like section;

a cornerstone having parallel top and bottom surfaces and disposed on the horizontal finished top surface provided by said number of base-stones to produce friction between the finished top surface provided by the base stones and the bottom surface of the cornerstone; and a pedestal having a centrally disposed recess on its bottom surface and positioned on the top surface of the cornerstone free of any mutual joining member therebetween except weight, with a resultant marginal portion of its bottom surface held in frictional contact with the top surface of the cornerstone;

wherein when an earthquake occurs in the ground, the base-stones are caused by a horizontal oscillatory wave of the earthquake to rotate and horizontally slide on the ground plane, providing an earthquake resisting capability for the structure.

3. An earthquake resisting support construction according to claim 2, in which the bottom surface of the pedestal is ring-shaped.

4. An earthquake resisting support construction which supports a structure at required support positions on the surface of ground having a bearing capacity of soil large enough to withstand the weight of the structure, comprising, at each support position:

a number of base-stones buried and arranged in the ground to provide a horizontal finished top surface;

a cornerstone having parallel top and bottom surfaces and disposed on the horizontal finished top surface provided by said number of base-stones to produce friction between the finished top surface provided by the base stones and the bottom surface of the cornerstone; and a pedestal having a centrally disposed recess on its bottom surface and positioned on the top surface of the cornerstone free of any mutual joining member therebetween except weight, with a resultant marginal portion of its bottom surface held in frictional contact with the top surface of the cornerstones, the bottom surface of the pedestal being ring-shaped;

wherein when an earthquake occurs in the ground, the cornerstone is caused by a horizontal oscillatory wave of the earthquake to horizontally slide on the finished surface provided by the base-stones, providing an earthquake resisting capability for the structure.

* * * * *